US011193326B1

(12) United States Patent
Neumann

(10) Patent No.: US 11,193,326 B1
(45) Date of Patent: Dec. 7, 2021

(54) INSULATIVE GLAZING PANEL

(71) Applicant: Melvin Neumann, Denver, CO (US)

(72) Inventor: Melvin Neumann, Denver, CO (US)

( * ) Notice: Subject to any disclaimer, the term of this patent is extended or adjusted under 35 U.S.C. 154(b) by 0 days.

(21) Appl. No.: 17/325,261

(22) Filed: May 20, 2021

(51) Int. Cl.
*E06B 9/264* (2006.01)
*E06B 3/67* (2006.01)

(52) U.S. Cl.
CPC ..... *E06B 9/264* (2013.01); *E06B 3/6722* (2013.01); *E06B 2009/2643* (2013.01)

(58) Field of Classification Search
CPC ..... E06B 9/264; E06B 2009/2643; E06B 2009/2646; E06B 9/581; E06B 7/096
See application file for complete search history.

(56) References Cited

U.S. PATENT DOCUMENTS 3,022,549 A 2/1962 Cummings
3,201,832 A * 8/1965 Hordis ..... E06B 9/264 49/64
3,211,264 A * 10/1965 Streeter, Jr. ..... E06B 9/264 49/67
3,342,244 A * 9/1967 Streeter, Jr. ..... E06B 9/264 160/107
3,742,648 A * 7/1973 Streeter, Jr. ..... E06B 9/364 49/74.1
4,002,159 A 1/1977 Angilletta
4,279,240 A 7/1981 Artusy
4,292,763 A 10/1981 Barnes et al.
4,355,676 A 10/1982 Lee
4,375,183 A * 3/1983 Lynch ..... F24F 13/15 137/601.09
4,684,911 A * 8/1987 Streeter ..... E06B 9/32 160/176.1 P
4,797,591 A * 1/1989 Streeter ..... E06B 9/36 160/104
5,014,481 A * 5/1991 Moe ..... E04B 1/74 52/406.3
5,718,274 A * 2/1998 Streeter ..... E06B 9/264 160/176.1 P
6,942,001 B1 * 9/2005 Crider ..... E06B 9/42 160/241
7,631,682 B2 * 12/2009 Larners ..... E06B 9/26 160/84.06
8,733,018 B2 5/2014 Couturier et al.
8,881,456 B2 11/2014 Xu
8,904,780 B1 12/2014 Makel
9,194,178 B2 * 11/2015 Andre de la Porte .... E06B 9/13
9,702,592 B2 7/2017 Reid et al.
9,719,292 B1 * 8/2017 James ..... E06B 9/0692
(Continued)

*Primary Examiner* — Catherine A Kelly
*Assistant Examiner* — Abe Massad
(74) *Attorney, Agent, or Firm* — MP Patents, LLC

(57) ABSTRACT

An insulative glazing panel includes a frame provided between first and second glazing panes and at least one blind assembly. The frame includes first and second generally parallel sides and third and fourth generally parallel sides generally perpendicular to and spacing apart the first and second sides. The at least one blind assembly is pivotably mounted between the first and second sides and has a pivot axis parallel with the third and fourth sides, a flexible, reflective base sheet having first and second ends each with a spacing block and a flexible, reflective top sheet spaced from the base sheet by the spacing blocks to which first and second ends of the top sheet are attached.

18 Claims, 4 Drawing Sheets

(56) References Cited

U.S. PATENT DOCUMENTS

| | | | | |
|---|---|---|---|---|
| 10,774,579 | B2 | 9/2020 | Harrison | |
| 2015/0041076 | A1 * | 2/2015 | Porte | E06B 9/581 160/266 |

* cited by examiner

INSULATIVE GLAZING PANEL

TECHNICAL FIELD

The disclosure relates to windows for buildings and, in particular, to controlling passage of light through windows and improving resistance to heat flow through windows.

BACKGROUND

Blinds are used to limit the amount of light entering a glazing but do not effectively reflect unwanted heat and light. Blinds used to insulate a glazing are too thick to admit a suitable amount of light when desired.

SUMMARY

The disclosure describes an insulative glazing panel including a frame, at least one blind assembly, first and second mounting rods and first second, third and fourth magnets. The frame includes first and second sides spaced apart by third and fourth sides. The at least one blind assembly is pivotably mounted between the first and second sides and has a pivot axis about parallel with at least one of the third and fourth sides, a flexible, reflective base sheet having first and second ends each with a spacing block and a flexible, reflective top sheet spaced from the base sheet by the spacing blocks to which first and second ends of the top sheet are attached. The first mounting rod extends from the first spacing block through a hole in the first side of the frame to a distal end exterior to the frame and has a first magnet at the distal end. The second magnet surrounds the hole in the first side at the frame exterior and is configured to repel the first magnet. A second mounting rod extends from the second spacing block through a hole in the second side of the frame to a distal end exterior to the frame and has a third magnet at the distal end. The fourth magnet surrounds the hole in the second side at the frame exterior and is configured to repel the third magnet. The mounting rods apply tension to the base sheet and the top sheet through the magnets and spacing blocks.

The disclosure further describes another insulative glazing panel including a frame provided between first and second glazing panes and at least one blind assembly. The frame includes first and second spaced apart sides sides. The at least one blind assembly is pivotably mounted between the first and second sides and has a pivot axis about perpendicular with at least one of the first and second sides, a flexible, reflective base sheet having first and second ends each with a spacing block and a flexible, reflective top sheet spaced from the base sheet by the spacing blocks to which first and second ends of the top sheet are attached.

Still further, the disclosure describes yet another insulative glazing panel including a frame between first and second glazings and at least one blind assembly. The frame includes first and second sides, a top and a bottom spacing apart the first and second sides. The at least one blind assembly is pivotably mounted between the first and second sides and has a pivot axis about parallel with at least one of the top and bottom, a flexible, reflective base sheet having first and second ends each with a spacing block and a flexible, reflective top sheet spaced from the base sheet by the spacing blocks to which first and second ends of the top sheet are attached.

BRIEF DESCRIPTION OF THE FIGURES

The summary above, as well as the following detailed description of illustrative embodiments, is better understood when read in conjunction with the appended drawings. For the purpose of illustrating the disclosure, example constructions are shown in the drawings. However, the disclosure is not limited to specific methods and instrumentalities disclosed herein. Moreover, those having ordinary skill in the art will understand that the drawings are not to scale. Wherever possible, like elements have been indicated by identical numbers.

Embodiments of the disclosure will now be described, by way of example only, with reference to the following diagrams wherein.

DETAILED DESCRIPTION

Figure 1:
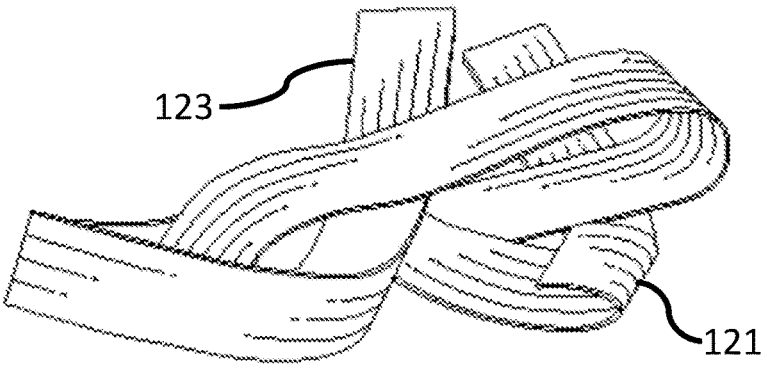
FIG. 1 illustrates flexible, reflective sheets suitable for use in association with disclosed apparatus and methods with the sheets in a relaxed state.
Figure 2:
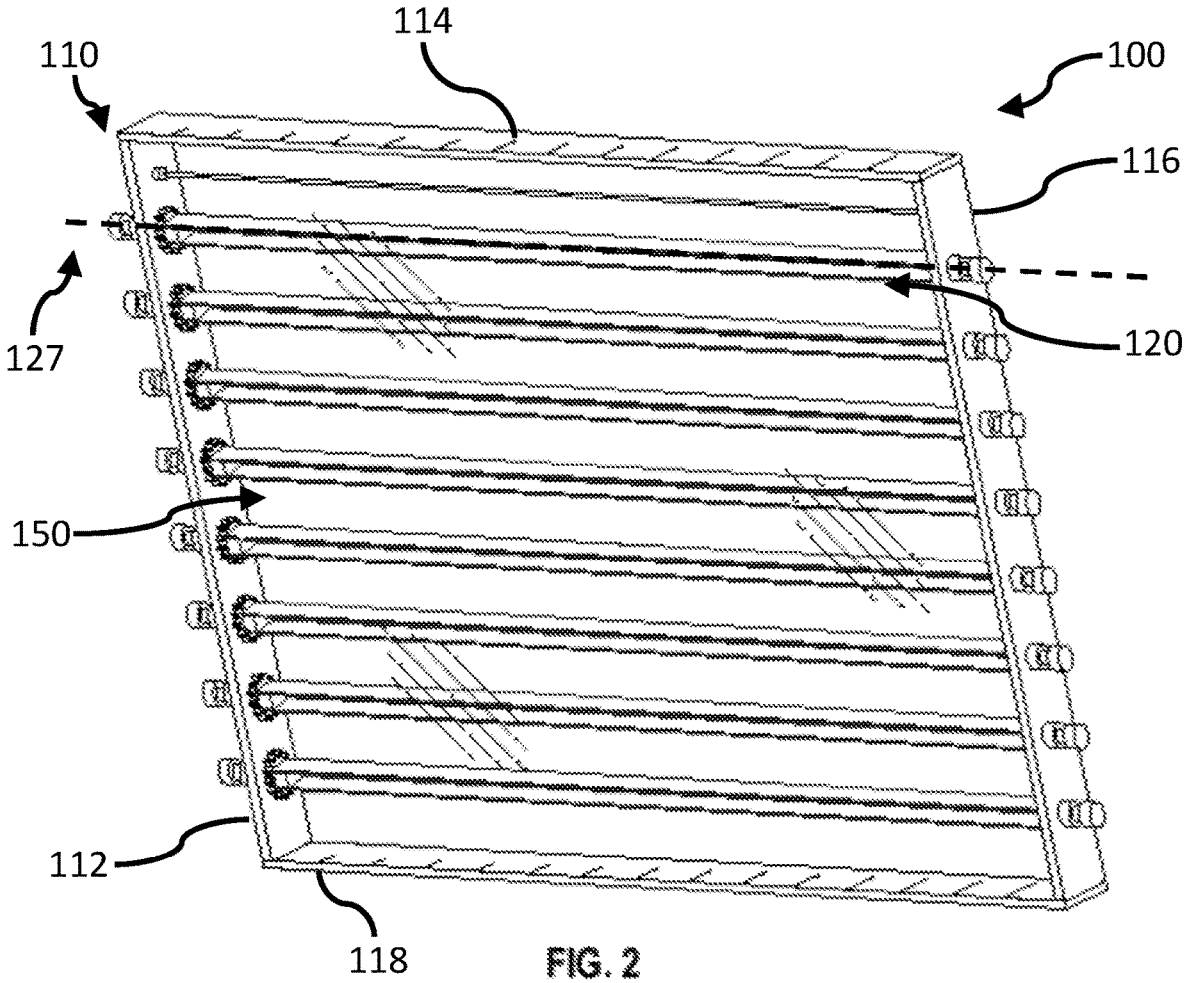
FIG. 2 illustrates a perspective view of an example insulative glazing panel with blinds in a fully open state.
Figure 3:
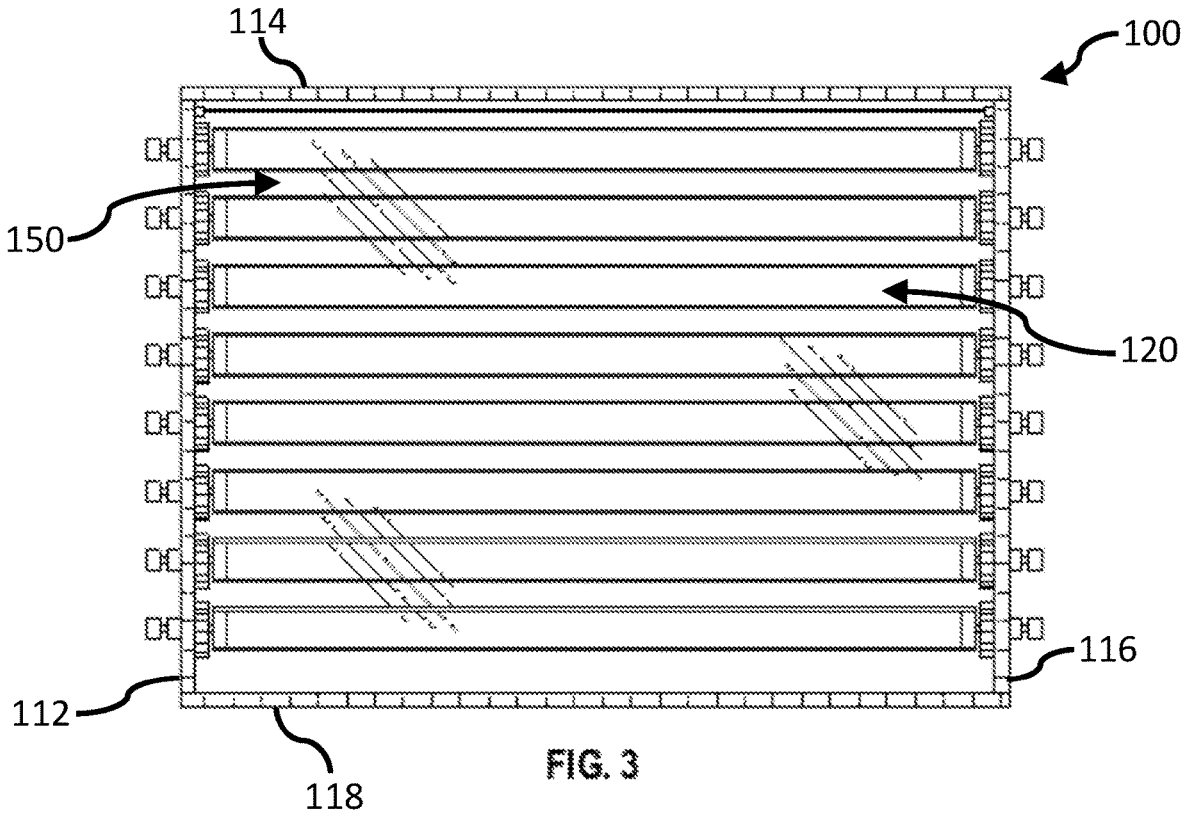
FIG. 3 illustrates a front view of the insulative glazing panel of FIG. 2 with example blind assemblies in a fully open state.
Figure 4:
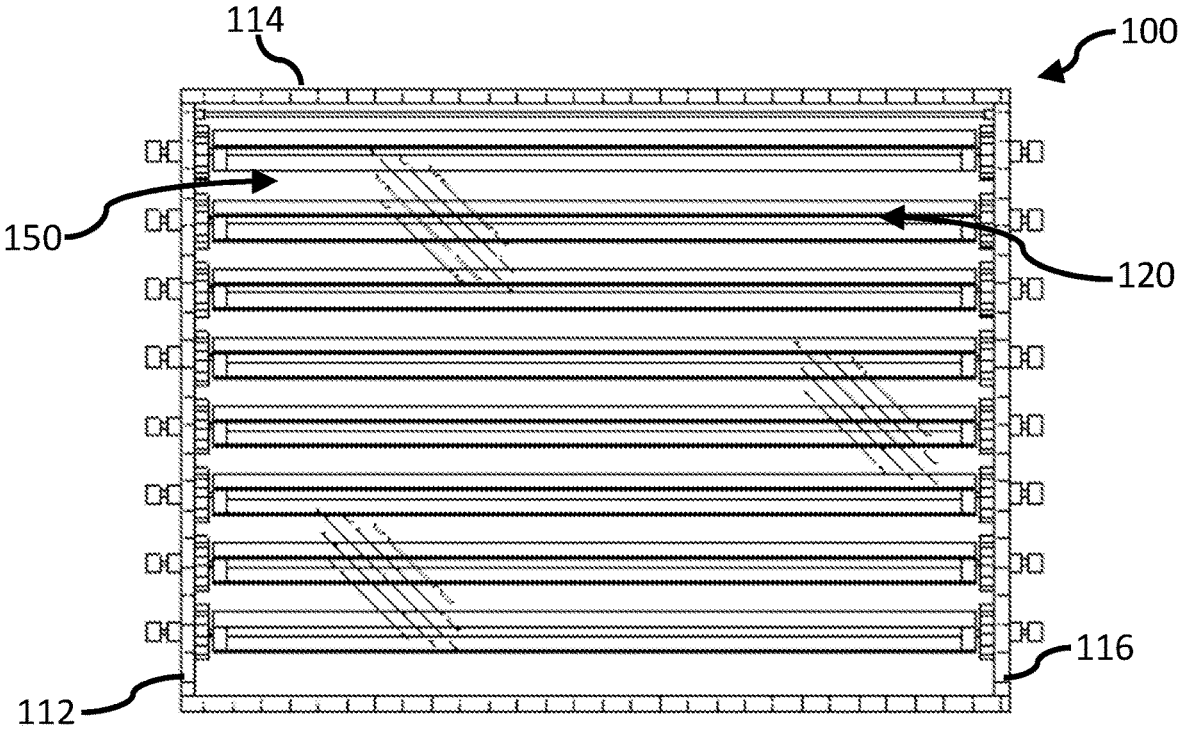
FIG. 4 illustrates a front view of the insulative glazing panel of FIGS. 2 & 3 with example blind assemblies in a partially closed state.

The following detailed description illustrates embodiments of the disclosure and manners by which they can be implemented. Although the preferred mode of carrying out disclosed systems, apparatus and methods has been described, those of ordinary skill in the art would recognize that other embodiments for carrying out or practicing disclosed systems, apparatus and methods are also possible.

It should be noted that the terms "first", "second", and the like, herein do not denote any order, quantity, or importance, but rather are used to distinguish one element from another. Further, the terms "a" and "an" herein do not denote a limitation of quantity, but rather denote the presence of at least one of the referenced item.

Embodiments of the disclosure provide a glazing panel and a thermal and/or solar energy management system and method.

Embodiments of the disclosure substantially eliminate, or at least partially address, problems in the prior art, enabling homeowners, greenhouse operators, building superintendents and other users to manage solar and thermal energy input and manage thermal energy loss.

Additional aspects, advantages, features and objects of the disclosure will be made apparent from the drawings and the detailed description of the illustrative embodiments construed in conjunction with the appended claims that follow. It will be appreciated that described features are susceptible to being combined in various combinations without departing from the scope of the disclosure as defined by the appended claims.

Referring to FIGS. 2-7, an insulative glazing panel 100 includes a frame 110 and one or more blind assemblies 120.

Frame 110 includes first and second sides 112 and 116 and third and fourth sides 114 and 118 spacing apart the first and second sides 112 and 114.

While frame 110 may take any of a variety of shapes suitable for accommodating one or more blind assemblies 120, first and second sides 112 and 116 may be about or nearly parallel and third and fourth sides 114 and 118 may be about or nearly perpendicular to first and second sides 112 and 114. Being about or nearly parallel, the first and second sides may generally have an angle therebetween of less than about 1 or 2 degrees. Similarly, the third and fourth sides may generally have an angle therebetween of less than about 1 or 2 degrees. With first and second sides being about perpendicular to the third and fourth sides, the first side may generally form an angle with the third and/or fourth side of about 88 to 92 degrees and the second side may generally form an angle with the third and/or fourth side of about 88 to 92 degrees.

As depicted by way of example in FIGS. 2-6, third side 114 may be considered a top side while fourth side 118 may be considered a bottom side. Nevertheless, glazing panel 100 may be used in any of a variety of orientations including but not limited to about or nearly horizontal, about or nearly vertical or at oblique angles to horizontal and/or vertical.

Figure 7:
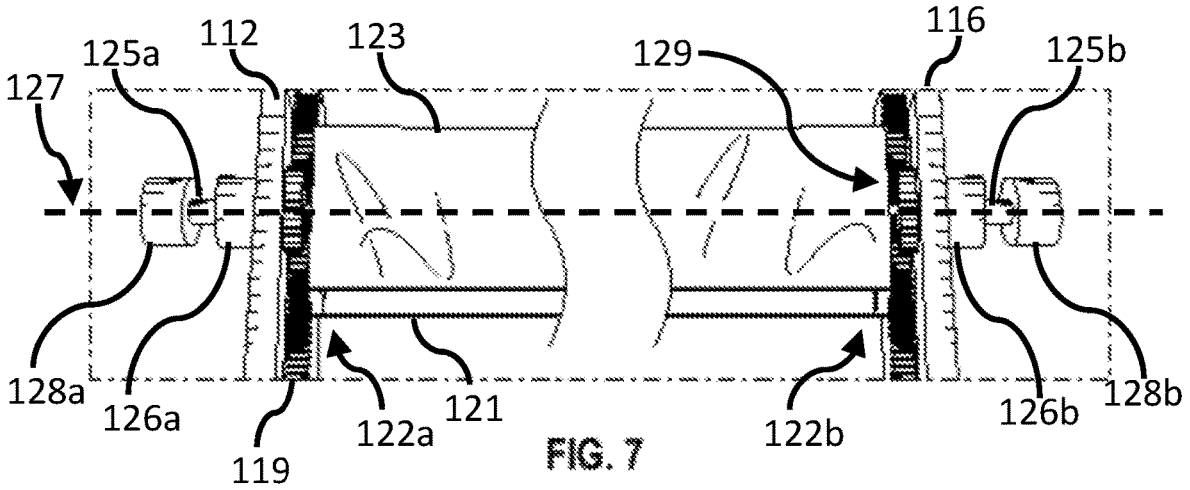
FIG. 7 illustrates a detail view of interaction between an example blind assembly and an example frame of the insulative glazing panel of FIGS. 2-6.

Referring to the detail view of FIG. 7, blind assemblies 120 are pivotably mounted between first and second sides 112 and 116 about a pivot axis 127 about or nearly parallel with third side 114 and/or fourth side 118 and include a flexible, reflective base sheet 121 having first and second ends each with a spacing block 122*a* or 122*b* and a flexible, reflective top sheet 123 spaced from base sheet 121 by spacing blocks 122*a* and 122*b* (collectively, 122) to which first and second ends of top sheet 123 are attached. Being about or nearly parallel with third side 114 and/or fourth side 118, pivot axis 127 may generally form an angle with third side 114 and/or fourth side 118 of less than about 1 or 2 degrees. It further follows from the above relationships that the pivot axis 127 may also be about or nearly perpendicular with first 112 and/or second 116 side such that an angle formed between the pivot axis and first 112 and/or second 116 side is about 88 to 92 degrees.

In an example, spacing blocks 122*a* and 122*b* may be mounted to base sheet 121 at a bottom surface of the blocks and may further include, about or nearly parallel with the bottom surface, a top surface to which top sheet 123 is attached. Being about or nearly parallel, the top and bottom surfaces of the blocks may generally have an angle therebetween of less than about 1 or 2 degrees. In one example, the height of the spacing blocks between base sheet 121 and top sheet 123 may be 1.9 cm. Spacing blocks 122 may be mounted and/or affixed to base sheet 121 or vice versa and top sheet 123 may be attached to spacing blocks 122 or vice versa by any of a variety of means including but not limited to adhesive.

Base sheet 121 and top sheet 123 may be flexible such that they do not support their own weight and/or do not maintain a fixed shape without an external force (FIG. 1). Base sheet 121 and top sheet 123 may be sufficiently reflective to reflect about 95% of light. While base sheet 121 and top sheet 123 may be formed from any of a variety of flexible, reflective materials including metalized paper and metal foil, in an example, base sheet 121 and top sheet 123 may be formed from a plastic film metallized on both sides. In a further example, the metallized film may be a metallized BoPET such as mylar. In another example, the base sheet and top sheet of the at least one blind assembly may have a thickness of about 0.0254 to 0.0508 mm.

One of several possible blind assemblies 120 is shown in in a closed or partially closed orientation in FIG. 7 and includes first and second mounting rods 125*a* and 125*b* (collectively referred to as 125) and first 126*a*, second 128*b*, third 126*b* and fourth 128*b* magnets (collectively, 126 and 128). First mounting rod 125*a* extends from first spacing block 122*a* through a hole in first side 112 of frame 110 to a distal end exterior to frame 110 and has a first magnet 128*a* at the distal end. Second magnet 126*a* surrounds the hole in first side 112 at the frame exterior and is configured to repel first magnet 128*a*. A second mounting rod 125*b* extends from second spacing block 122*b* through a hole in second side 116 of frame 110 to a distal end exterior to frame 110 and has a third magnet 128*b* at the distal end. Fourth magnet 126*b* surrounds the hole in second side 116 at the frame exterior and is configured to repel third magnet 128*b*. Mounting rods 125 apply tension to base sheet 121 and top sheet 123 through magnets 126, 128 and spacing blocks 122 to keep the sheets taut.

Magnets 126 and 128 may take any of a variety of shapes suitable for mounting to frame 110 and/or mounting rods 125 in repelling pairs so as to apply tension to sheets 121 and 123 and/or bias spacing blocks 122 towards the respective first and second sides of frame 110 and/or bias blind assemblies 120 to a centered position between the first and second sides of frame 110. For example, magnets 126 and 128 may take a cylindrical shape with an annular cross section configured such that an inner diameter may receive and or engage with a mounting rod 125.

Insulative glazing panel 100 may further include a first glazing pane 150 (FIGS. 2-5) affixed to front edges of the first, second, third and fourth sides of frame 110 and a second glazing pane 170 affixed to rear edges of the first, second, third and fourth sides of frame 110 so as to seal the one or more blind assemblies 120 between the first, second, third and fourth sides of frame 110 and first and second glazing panes 150 and 170. In an example, first and second glazing panes 150 and 170 may be spaced apart by 5.7 cm.

Figure 5:
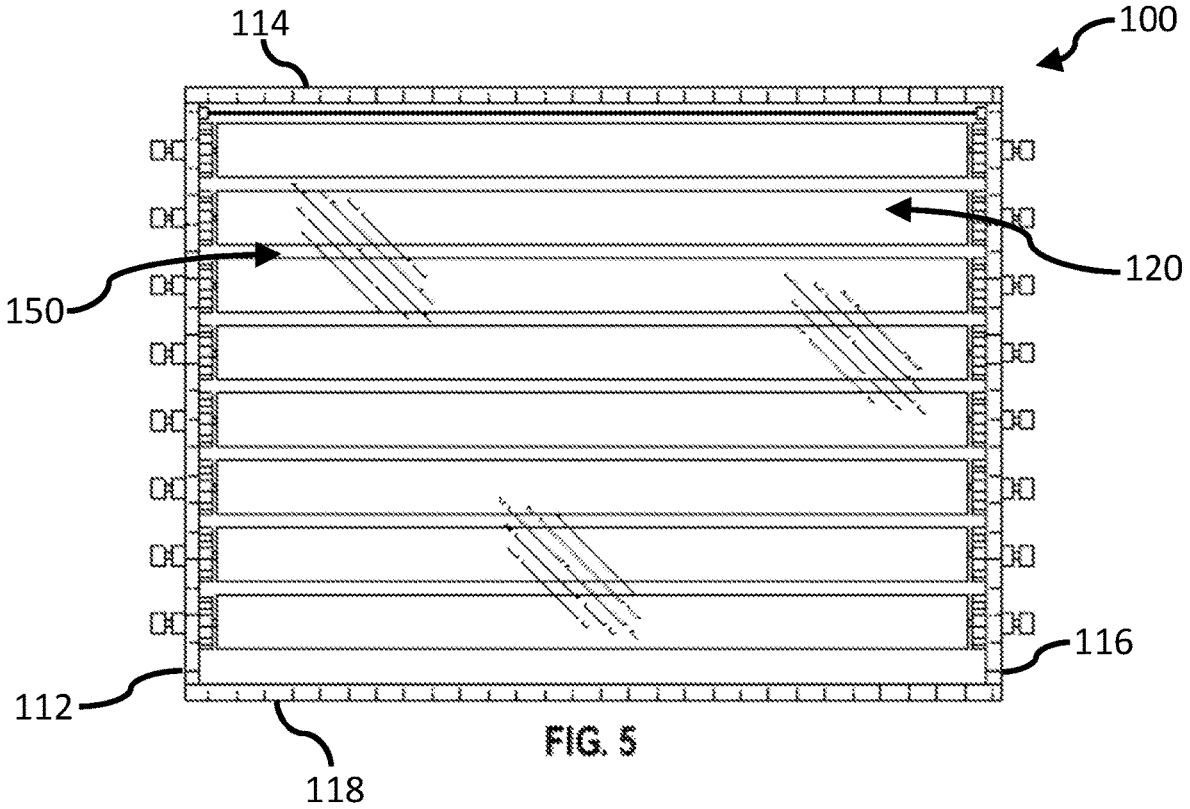
FIG. 5 illustrates a front view of the insulative glazing panel of FIGS. 2-4 with example blind assemblies in a fully closed state.
Figure 6:
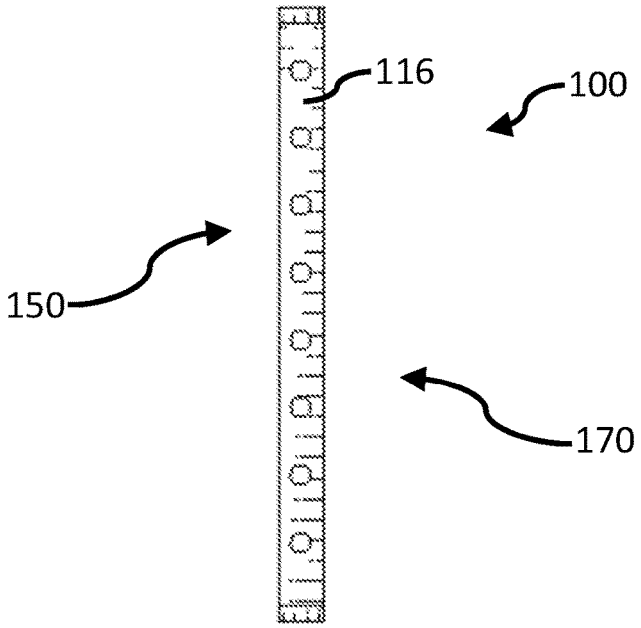
FIG. 6 illustrates a side view of the insulative glazing panel of FIGS. 2-5.

While illustrated with eight blind assemblies, insulative glazing panel 100 may include any number of blind assemblies from one to dozens depending on the size of the glazing panel. When more than one blind assembly is included, each blind assembly 120 may be configured to rotate about a pivot axis such as axis 127 so that the base sheets of adjacent blind assemblies form a large, nearly continuous surface and the top sheets of adjacent blind assemblies form a large, nearly continuous surface generally parallel with the large, nearly continuous surface of the base sheets (FIG. 5).

Additionally or alternatively each blind assembly 120 may be configured to rotate about pivot axis such that edges of the base sheets of adjacent blind assemblies meet or nearly meet and edges of the top sheets of adjacent blind assemblies meet or nearly meet.

Further, blind assemblies 120 may each be configured such that when rotated about the pivot axis such that the base and top sheets are about or nearly parallel with the first and second glazing panes 150 and 170, a first pocket is formed between the base sheets 121 of adjacent blind assemblies and the first glazing pane 150, a second pocket is formed between the base sheets 121 of the adjacent blind assemblies and the top sheets 123 of the adjacent blind assemblies, and a third pocket is formed between the top sheets 123 of the adjacent blind assemblies and the second glazing pane 170.

It should be noted that the blind assemblies may also be rotated to any of a variety of intermediate orientations (FIG. 4) wherein the base and top sheets are neither perpendicular to nor parallel with the first and/or second glazing panes. For example, the base and/or top sheets may be rotated to an angle of 30 degrees, 45 degrees, 60 degrees or 75 degrees.

In an alternative or addition to magnets, one or more coil springs may be provided to apply tension to sheets 121 and 123 and/or bias the mounting blocks towards the respective first and second sides of frame 110 and/or bias the blind assemblies 120 toward a centered position in frame 110. For example, a first coil spring may be provided between a first side of the frame and a shoulder provided at the distal end of a first mounting rod and a second coil spring may be provided between an opposite side of the frame and a shoulder provided at the distal end of an opposing mounting rod.

A gear 129 fixedly mounted to each of the mounting rods is configured to, upon rotation, pivot the blind assembly between open and closed orientations. The gear may be configured with teeth to engage or interlock with a rack 119 provided to glazing panel 100. A motor may be provided to drive the rack or the rack may be actuated manually to pivot the blind assemblies through respective sprockets of the mounting rods.

Figure 8:
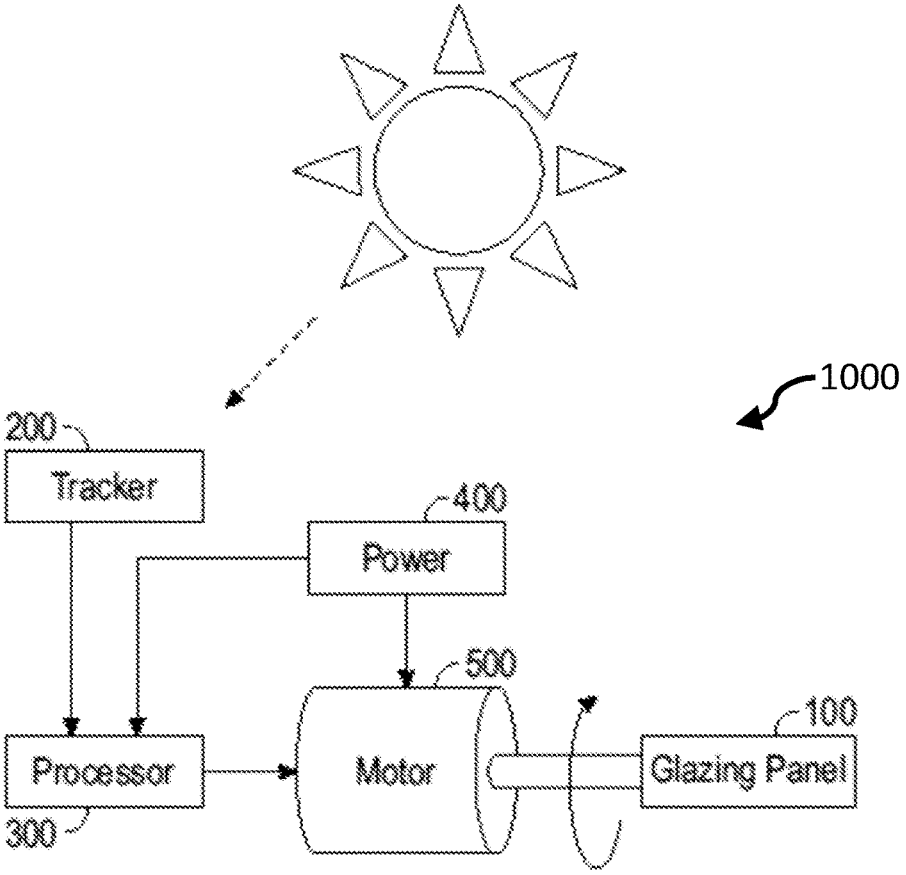
FIG. 8 schematically illustrates example components of a system for thermal/solar energy management.

Referring to FIG. 8, disclosed glazing panels may be suitable for use in association with a thermal/solar energy management system 1000. Thermal/solar energy management system 1000 may further include a sun tracking device 200 configured to receive information pertaining to sun position and/or intensity. With information input from sun tracking device 200, microcontroller 300 may control a motor 500 to move rack 119 to rotate gear 129 and, in turn, rods 125 and blind assemblies 120.

In an alternative to a gear and rack arrangement, a sprocket fixedly mounted to each of the mounting rods is configured to, upon rotation, pivot the blind assembly between open and closed orientations. The sprocket may be configured with teeth to engage or interlock with a chain provided to the glazing panel. A motor may be provided to drive the chain or the chain may be pulled manually to pivot the blind assemblies through respective sprockets of the mounting rods.

An example method of assembling and using an insulative glazing panel is now described. A frame is provided including first and second sides and third and fourth spacing apart the first and second sides. Between the first and second sides, a plurality of blind assemblies are pivotably mounted. Each blind assembly has a pivot axis aligned with the third and fourth sides, a flexible, reflective base sheet of metalized film having first and second ends each with a spacing block and a flexible, reflective top sheet of metalized film spaced from the base sheet by the spacing blocks to which first and second ends of the top sheet are attached.

Mounting holes are provided through the first and second sides of the frame. A mounting rod is inserted into each of the spacing blocks. Each mounting rod extends from the spacing block through one of the mounting holes in the first or second sides of the frame to a distal end exterior to the frame and has a first magnet at the distal end. Each hole is surrounded at the frame exterior with a second magnet configured to repel the first magnet.

A first glazing pane is affixed to front edges of the first, second, third and fourth sides and a second glazing pane is affixed to rear edges of the first, second, third and fourth sides so as to seal the at least one blind between the first, second, third and fourth sides of the frame and the first and second glazing panes.

During winter when outdoor temperatures can be low, the blind assemblies are set to a rotation suitable for allowing heat and light from the sun to pass through the glazing panel during the day. At the end of the day, the blind assemblies are then rotated, either through the described gear and rack arrangement or the sprocket and chain arrangement, to a closed position. The three pockets of insulating air are thereby formed between the blind assemblies and the first and second glazing panes to retain heat that has accumulated over the course of the day. As such, a user may employ the insulative glazing panel for insulating an enclosed space against heat loss.

During summer when outdoor temperatures can be high, the blind assemblies are kept closed during the day to reflect heat and light back out to the surroundings. At night, the blinds may be kept closed or may be opened through the described gear and rack arrangement or the sprocket and chain arrangement to allow any accumulated heat to escape.

As suggested from the above descriptions of a thermal/solar energy management system, a user may employ a sun tracking device to track the position of the sun and feed the received information to a microcontroller which operates a motor to rotate the blind assemblies. For example, the blind assemblies change rotation continuously over the course of a winter day so as to allow maximum sunlight through the glazing panel and then close at night. The motor and/or microcontroller may be powered by photoelectric cells and a rechargeable battery.

In an alternative, a user manually pulls on a chain in a first direction to drive one or more sprockets on each of the blind assembly mounting rods to turn the mounting rods and, therefore, the blind assemblies in a first direction to close the blind assemblies. In an example which overcomes the inaccessibility of components internal to the sealed glazing panel 100, a moveable magnetic element provided exterior to the glazing panel is moved by the user to move, in a first direction, an attracted magnetic element coupled with the chain so as to move the chain and rotate the sprockets. In another example, the user moves a magnetic element exterior to the glazing panel in the first direction to move an attracted magnetic element coupled with a rack so as to move the rack and rotate the gears with which the rack is engaged.

To open the blind assemblies, a user manually pulls on the chain in a direction opposite the first direction to drive one or more sprockets on each of the blind assembly mounting rods to turn the mounting rods and, therefore, the blind assemblies in a second direction to open the blind assemblies. In an example, the user moves the magnetic element in a direction opposite the first direction to move the attracted magnetic element coupled with the chain so as to move the chain and rotate the sprockets. In another example, the user moves a magnetic element exterior to the glazing panel in a direction opposite the first direction to move an attracted magnetic element coupled with a rack so as to move the rack and rotate the gears with which the rack is engaged.

The actions described above are only illustrative and other alternatives can also be provided where one or more actions are added, one or more actions are removed, or one or more actions are provided in a different sequence without departing from the scope of the claims herein.

Embodiments of the disclosure are susceptible to being used for various purposes, including, though not limited to, enabling users to to manage thermal and/or solar energy.

Modifications to embodiments of the disclosure described in the foregoing are possible without departing from the scope of the disclosure as defined by the accompanying claims. Expressions such as "including", "comprising", "incorporating", "consisting of", "have", "is" used to describe and claim disclosed features are intended to be construed in a non-exclusive manner, namely allowing for items, components or elements not explicitly described also to be present. Reference to the singular is also to be construed to relate to the plural.

What is claimed is:

1. An insulative glazing panel, comprising:

a frame including first and second sides spaced apart by third and fourth sides;

at least one blind assembly pivotably mounted between the first and second sides and having:

a pivot axis substantially parallel with at least one of the third and fourth sides;

a flexible, reflective base sheet having first and second ends each with a spacing block;

a flexible, reflective top sheet spaced from the base sheet by the spacing blocks to which first and second ends of the top sheet are attached;

a first mounting rod extending from the first spacing block through a hole in the first side of the frame to a distal end exterior to the frame and having a first magnet at the distal end;

a second magnet surrounding the hole in the first side at an exterior of the frame and configured to repel the first magnet;

a second mounting rod extending from the second spacing block through a hole in the second side of the frame to a distal end exterior to the frame and having a third magnet at the distal end; and a fourth magnet surrounding the hole in the second side at the exterior of the frame and configured to repel the third magnet such that the mounting rods apply tension to the base sheet and the top sheet.

2. The insulative glazing panel as set forth in claim 1, wherein the magnets are annular.

3. The insulative glazing panel as set forth in claim 1, further comprising a first glazing pane affixed to front edges of the first, second, third and fourth sides.

4. The insulative glazing panel as set forth in claim 3, a second glazing pane affixed to rear edges of the first, second, third and fourth sides so as to seal the at least one blind assembly between the first, second, third and fourth sides of the frame and the first and second glazing panes.

5. The insulative glazing panel as set forth in claim 1, wherein the at least one blind assembly further comprises a plurality of blind assemblies.

6. The insulative glazing panel as set forth in claim 5, wherein each of the plurality of blind assemblies is configured to rotate about pivot axes such that edges of the base sheets of adjacent blind assemblies meet and edges of the top sheets of adjacent blind assemblies meet.

7. An insulative glazing panel, comprising:

between first and second glazing panes, a frame including first and second spaced apart sides;

at least one blind assembly pivotably mounted between the first and second sides and having:

a pivot axis substantially perpendicular with at least one of the first and second sides;

a flexible, reflective base sheet having first and second ends each with a spacing block;

a flexible, reflective top sheet spaced from the base sheet by the spacing blocks to which first and second ends of the top sheet are attached; and biasing means provided to each spacing block to bias the spacing blocks towards the respective first or second side of the frame, said biasing means comprising a first magnet and a second magnet configured to repel each other.

8. The insulative glazing panel as set forth in claim 7, wherein the base sheet and the top sheet of the at least one blind assembly further comprise a metallized film.

9. The insulative glazing panel as set forth in claim 7, wherein the base sheet and top sheet of the at least one blind assembly further comprise a thickness of 0.0254 to 0.0508 mm.

10. The insulative glazing panel as set forth in claim 7, wherein the spacing blocks are mounted to the base sheet at a bottom surface and further include, generally parallel with the bottom surface, a top surface to which the upper sheet is attached.

11. The insulative glazing panel as set forth in claim 7, further comprising, a mounting rod extending from each of the spacing blocks through respective holes in the first and second sides of the frame to a distal end exterior to the frame.

12. The insulative glazing panel as set forth in claim 7, wherein the at least one blind assembly further comprises a plurality of blind assemblies each configured to rotate about pivot axes and form a first pocket between the base sheets of adjacent blind assemblies and the first glazing pane, a second pocket between the base sheets of the adjacent blind assemblies and the top sheets of the adjacent blind assemblies, and a third pocket between the top sheets of the adjacent blind assemblies and the second glazing pane.

13. An insulative glazing panel, comprising:

between first and second glazings, a frame including first and second sides, a top and a bottom spacing apart the first and second sides;

at least one blind assembly pivotably mounted between the first and second sides and having:

a pivot axis substantially parallel with at least one of the top and bottom;

a flexible, reflective base sheet having first and second ends each with a spacing block;

a flexible, reflective top sheet spaced from the base sheet by the spacing blocks to which first and second ends of the top sheet are attached;

extending from each of the spacing blocks through respective holes in the first and second sides of the frame to first and second distal ends exterior to the frame is one mounting rod having a first magnet at the first distal end; and a magnet surrounding each hole at an exterior of the frame and configured to repel the first magnet.

14. The insulative glazing panel as set forth in claim 13, wherein the base sheet and the top sheet of the at least one blind assembly further comprise a metallized film.

15. The insulative glazing panel as set forth in claim 13, wherein the base sheet and top sheet of the at least one blind assembly further comprise a thickness of 0.0254 to 0.0508 mm.

16. The insulative glazing panel as set forth in claim 13, wherein the spacing blocks are mounted to the base sheet at a bottom surface and further include, generally parallel with the bottom surface, a top surface to which the upper sheet is attached.

17. The insulative glazing panel as set forth in claim 13, further comprising at least one sprocket fixedly mounted each of the mounting rods and configured to, upon rotation, pivot the blind assembly between open and closed orientations.

18. The insulative glazing panel as set forth in claim 13, wherein the at least one blind assembly further comprises a plurality of blind assemblies each configured to rotate about pivot axes and form a first pocket between the base sheets of adjacent blind assemblies and the first glazing pane, a second pocket between the base sheets of the adjacent blind assemblies and the top sheets of the adjacent blind assemblies, and a third pocket between the top sheets of the adjacent blind assemblies and the second glazing pane.

* * * * *